United States Patent [19]

Hess

[11] 4,351,488

[45] Sep. 28, 1982

[54] FEED BARS FOR SHREDDING MILLS

[75] Inventor: Viktor Hess, Augsburg, Fed. Rep. of Germany

[73] Assignee: Alpine Aktiengesellschaft, Fed. Rep. of Germany

[21] Appl. No.: 870,434

[22] Filed: Jan. 18, 1978

Related U.S. Application Data

[63] Continuation of Ser. No. 696,279, Jun. 15, 1976, abandoned.

[51] Int. Cl.[3] ..... B02C 18/22

[52] U.S. Cl. ..... 241/224; 241/238

[58] Field of Search ..... 241/73, 222, 224, 225, 241/238, 241, 242; 83/349, 658

[56] References Cited

U.S. PATENT DOCUMENTS

| | | | |
|---|---|---|---|
| 2,172,886 | 9/1939 | Gabel | 241/224 |
| 2,216,612 | 10/1940 | Dimm | 241/241 X |
| 2,830,770 | 4/1958 | De Luca | 241/73 |
| 3,217,765 | 11/1965 | Anderson | 241/225 X |
| 3,510,077 | 5/1970 | Priscu | 241/241 |

FOREIGN PATENT DOCUMENTS

| | | | |
|---|---|---|---|
| 2309400 | 9/1974 | Fed. Rep. of Germany | 241/222 |

*Primary Examiner*—Howard N. Goldberg
*Attorney, Agent, or Firm*—Pennie & Edmonds

[57] ABSTRACT

A rotary shredding mill has provision for changing the size and shape of the entrance throat as well as the location of the stationary cutting edge. Such provision include a removable feed bar which may be replaced with other feed bars of different cross-section.

10 Claims, 4 Drawing Figures

FEED BARS FOR SHREDDING MILLS

This is a continuation of application Ser. No. 696,279, filed June 15, 1976, now abandoned.

BACKGROUND OF THE INVENTION

The invention relates to shredding mills having a horizontal or vertical rotor shaft, and concerns the advantageous conformation of a replaceable feed bar arranged in the entrance throat of the operating zone of such a shredding mill to influence the size and shape of said entrance throat and hence ability of the mill to accept materials.

Known shredding mills are used for comminution of materials of all kinds. One of their principal fields of application is the shredding of all sorts of synthetic materials.

The shredability of a material depends primarily on its suitability or unsuitability for acceptance by a given mill. Such acceptability is determined primarily by the size, shape and weight of the pieces to be put in; in addition, however, there are physical and mechanical parameters of the material such as strength, elasticity, hardness, toughness etc.

In the second place, the shredability of a material depends also on the ability of the mill to accept a particular material to be shredded. This ability is controlled by performance data and design factors such as rotor speed, number and arrangement of knives, rotor design, arrangement of rotor in relation to the operating space, conformation of the operating space and feeding means, etc. The accepting ability of a given mill is thus fixed, and optimal shredding performance can be achieved only if the acceptability of the material matches the accepting ability of the mill. Otherwise, either the mill may jam because the material is accepted too rapidly, or it may fail to perform at full capacity because the material is insufficiently accepted or not at all.

THE PRIOR ART

It is known that one of the most important factors affecting the accepting ability of a shredding mill is the configuration of the feed portion. In particular, the size and shape of the entrance throat bounded by the entrance portion of the housing wall and the envelope described by the cutting edges of the rotor blades, as well as its arrangement in relation to the mill rotor, has a considerable influence on accepting ability.

An especially good accepting ability is possessed for example by a shredding mill constructed according to German Letters of Disclosure No. 2,309,400, where the entrance portion of the operating zone is drawn in an arc around the rotor of the mill, so that an acutely tapered entrance throat results.

Devices have likewise been disclosed whereby the size of the entrance throat can be varied. Thus German Pat. No. 924,950 describes a wood-grinding machine in which a pivotable backstop rail forms a variable feed space with the front of a knifeblade rotating about a horizontal axis. According to the particular wood to be chipped at a given time, it is possible to find a setting of the rail at which the material supplied will be fed in more or less automatically.

The shredding mill with horizontal rotor shaft as described in German Public Disclosure No. 1,964,111 likewise has an entrance throat capable of being modified in size by the bottom of a pivoted feed chute.

A disadvantage here is that the particular material will be imperfectly matched, since the other determining parameters of the entrance throat, namely shape and arrangement, cannot be varied. In shredding mills, furthermore, a pivoted construction of the entire feed chute or its bottom involves a great deal of engineering outlay, and its handling in the charging of the mill is seriously impeded.

SUMMARY OF THE INVENTION

The object of the invention, accordingly, is to provide a means whereby, in shredding mills with horizontal or vertical rotor shaft, the entrance throat portion of the operating space may be varied in shape, size and arrangement with respect to the mill rotor, in a simple manner, so as to adapt the accepting ability of the mill in large measure to the materials to be processed from time to time.

This object is accomplished by such configurations of a replaceable feed bar to be arranged in the feed portion of the operating zone of a shredding mill with horizontal or vertical rotor axis that the part of the feed bar towards the rotor of the mill and extending parallel to the rotor shaft has two surfaces forming a cutting edge, of which surfaces the anterior one—in the direction of rotation of the rotor—forms a prolongation of the housing wall bounding the entrance throat of the operating space, almost all the way to the knife circle, forming a wedge-shaped entrance throat together with the envelope of the knife circle. The said anterior surface may be a curved surface, for example in order to achieve a smooth transition to the housing wall bounding the entrance portion of the device.

In a preferred embodiment of the feed bar according to the invention, the angle $\alpha$ between planes through the cutting edge tangential to the anterior surface and the envelope of the knife circle measures between 10° and 140°. The feed bar may be replaced by a feed bar of different cross-section in order to adapt the mill to different materials.

U.S. Pat. No. 2,261,090 in fact discloses a bar in the feed space of a shredding mill, having an edge cooperating with the rotor knives, its anterior surface—in the direction of rotation of the rotor—extending as far as the envelope. This known arrangement, however, serves the purpose of separating foreign bodies difficult to grind, such as iron parts, stones etc., from the material charged into the mill in the operating space, in order to protect the shredding tools and other parts of the mill from damage.

A feed bar constructed according to the invention, on the other hand, serves to permit modification of the entrance throat of a shredding mill of otherwise fixed design in a simple manner, the factors of shape, size, and arrangement in relation to the rotor being adaptable to a large extent independently of each other to the intended purpose. Thus it is possible by suitable choice of the position of the cutting edge on the feed bar—for example in terms of the distance of the cutting edge from an imaginary fixed plane through the axis of the rotor—to draw the entrance throat a greater or lesser distance around the rotor, and/or by suitable choice of the angle $\alpha$ to influence the size and shape of the entrance throat.

Since the cutting edge on the feed bar according to the invention is subject to severe strain due to the cutting stresses involved, it is advantageous if this cutting edge is formed by a stationary knife replaceably inserted in the feed bar, and having, for the sake of standardization of parts, the same dimensions as the stationary knives cooperating with the rotor in the operating space of the mill. Like cutting action is achieved if the cutting edge is at the same distance from the rotor knife circle envelope as the cutting edges of the stator knives.

To prevent bits of material from catching between the rotor and the feed bar, it is desirable for the posterior surface—in the direction of rotation of the rotor—of the bar to be so shaped that its distance from the knife circle envelope increases continuously in the direction of rotation of the rotor.

For a secure mounting capable of absorbing heavy loads, a preferred embodiment provides an arrangement of the feed bar in a recess in the wall of the entrance part of the housing.

A precise adjustment of the distance between the cutting edge on the feed bar and the knife circle envelope is simply and advantageously achieved by shims of suitable thickness inserted between the feed bar and the wall of the entrance portion of the housing.

BRIEF DESCRIPTION OF THE DRAWINGS

Embodiments of the invention are schematically represented in the drawings and will be described below by way of example.

DETAILED DESCRIPTION OF THE INVENTION

Figure 1:
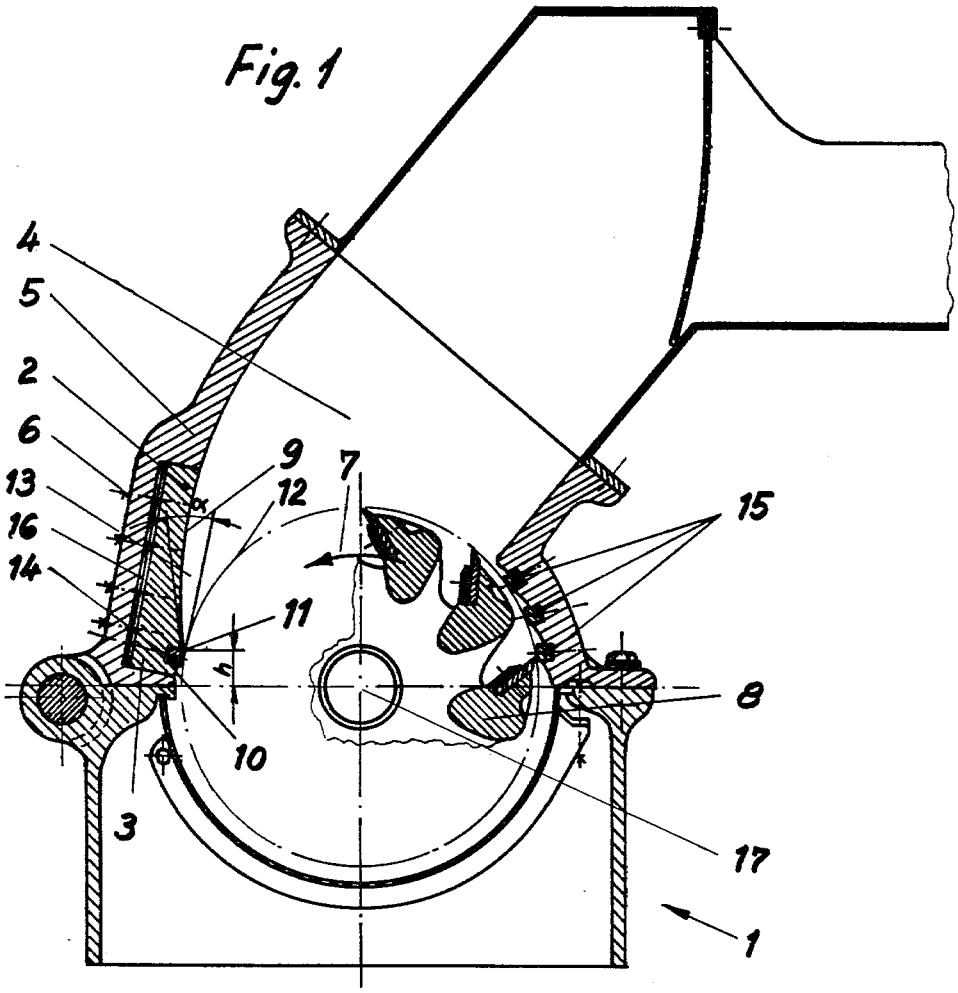
FIG. 1 shows a cross-section of a shredding mill with horizontal rotor shaft and a feed bar in the entrance throat of the working chamber.

In the shredding mill 1 represented in FIG. 1, the feed bar 2 is fixed in a groove 3 in the wall 5 of the housing, bounding the entrance chamber 4, by means of screws 6. The surface 9—anterior in the direction of rotation 7 of rotor 8—of feed bar 2 is a curved surface making a smooth transition with the housing wall 5. The anterior surface 9, forming a cutting edge 11 with the posterior surface 10, is brought approximately as far as the knife circle 12, with the envelope of which it forms a wedge-shaped entrance throat 13. The cutting edge 11 itself is in the form of a replaceable stationary knife 14, which for the sake of standardization of parts has the same dimensions as the stator knives 15 in the housing wall 19 bounding the working chamber, cooperating with the rotor 8. Shims 16 serve to determine the precise distance of the cutting edge 11 from the knife circle 12. The angle $\alpha$ between the planes passed through the cutting edge 11 tangential to the anterior surface 9 and the knife circle envelope 12 is in this instance about 20° (30°, in FIG. 4), so that a comparatively acute tapered entrance throat 13 is obtained. The distance h from the cutting edge 11 to the horizontal plane of the rotor shaft 17 defines the position of the cutting edge 11 and hence also the entrance throat 13 in relation to the rotor 8. In FIG. 1, the value of h is small, corresponding to an entrance throat drawn a considerable distance around the rotor 8. Such a conformation is especially suitable for shredding of light, bulky material, for example plastic bottles.

Figure 2:
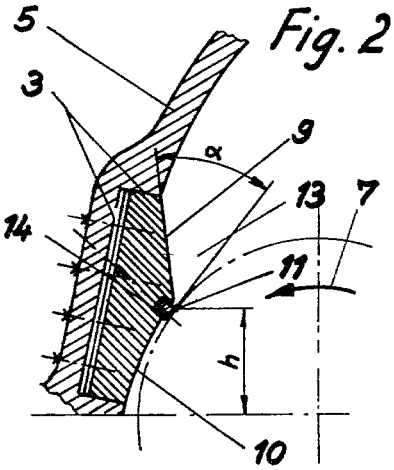
FIGS. 2 and 3 show two additional forms of feed bar for the shredding mill of FIG. 1 having different cross-sections.
Figure 3:
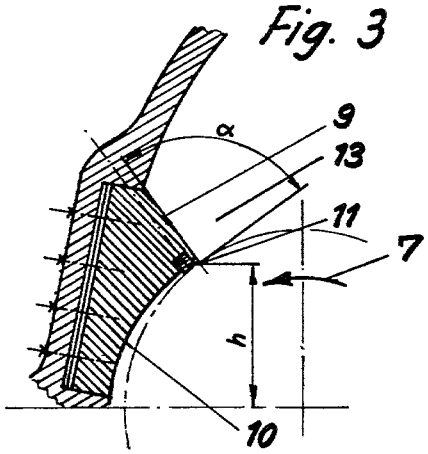

FIGS. 2 and 3 show additional forms of either of the feed bar for the shredding mill 1 of FIG. 1 showing examples of different cross-sections for the feed bar.

Here the anterior surfaces 9 are plane surfaces, making an obtuse angle with the housing wall 5. The distance h is greater than in FIG. 1 so that the entrance throat 13 extends a lesser distance around the rotor 8. Furthermore, the anterior surface 9—especially in the embodiment of FIG. 3—forms a support for the material being fed and cut, the adoption of which is especially advantageous when heavy, solid fragments of material are to be shredded. The posterior surface 10 is so constructed that its distance from the knife circle envelope 12 increases steadily in the direction of rotation 7 of the rotor 8, so that bits of material will not be trapped between rotor 8 and feed bar 2.

Figure 4:
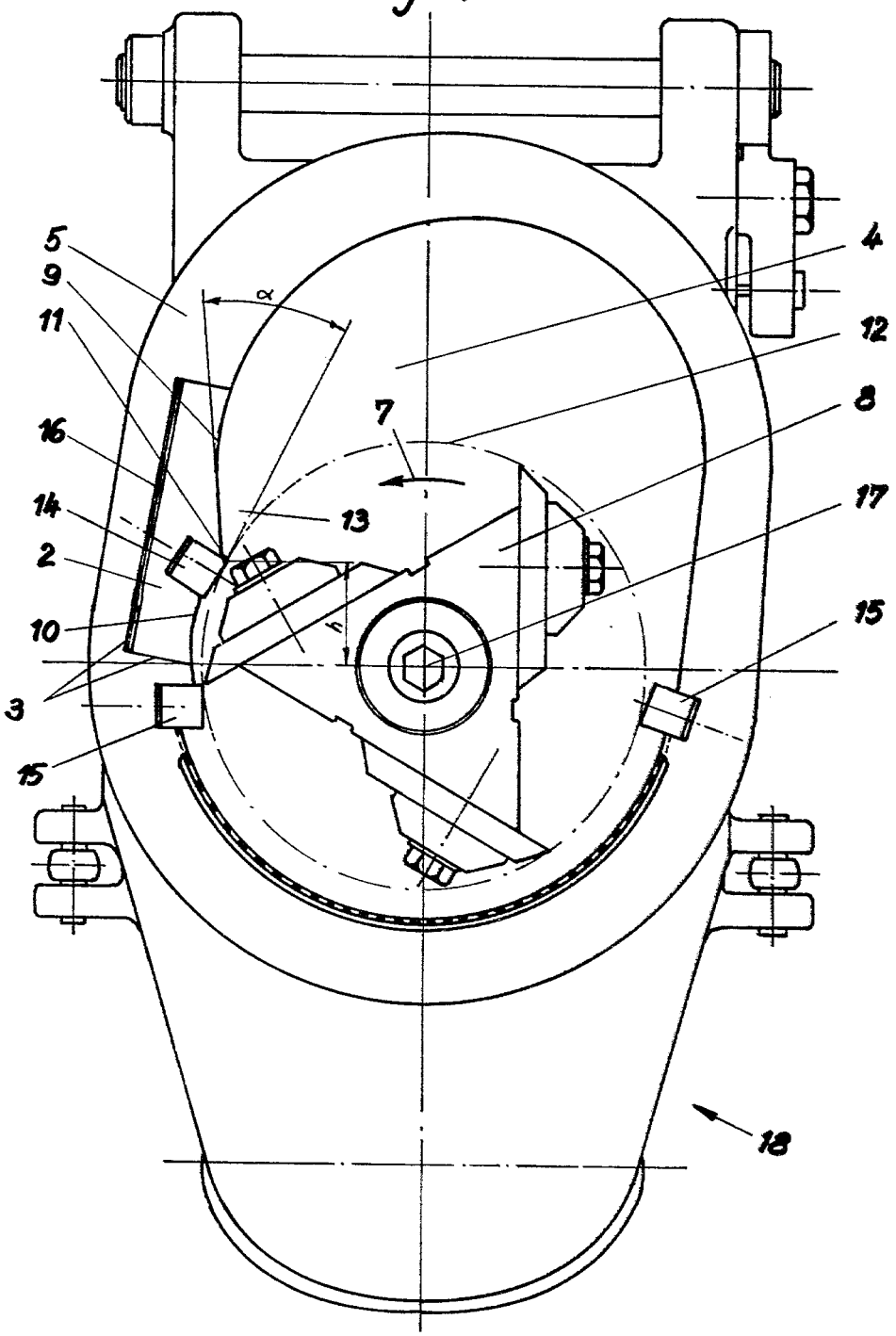
FIG. 4 shows a top view of a shredding mill with vertical rotor shaft and a feed bar in the entrance throat of the working chamber.

FIG. 4 represents the arrangement of a feed bar 2 in the wall 5 of the entrance chamber 4 of a shredding mill 18 with vertical rotor shaft 17. Otherwise, the comments already given on the previous figures again apply, corresponding parts or features having been identified by the same references. Of course, feed bars shown in FIGS. 1, 2 and 3 may alternatively be installed in a shredding mill 18 according to FIG. 4.

I claim:

1. A shredding mill comprising a rotor, a plurality of knife edges carried by said rotor on the periphery thereof for rotation about the axis of the rotor, the path of the knife edges about said axis defining a cylindrical envelope, a housing in part defining an entrance chamber for feeding material to said rotor to be shredded, said entrance chamber including a generally wedge-shaped entrance throat, said throat being in part defined by said envelope, a feed bar removably mounted to said housing, said feed bar having two intersecting surfaces, one of said surfaces being anterior and the other posterior with respect to the direction of rotation of said rotor, said anterior surface in part defining said entrance throat, a stationary cutting edge positioned substantially at the intersection of said surfaces and parallel to the axis of said rotor, said cutting edge being closely adjacent to said enveloped for cooperating with the knife edges of said rotor, means other than a pivotable means for varying the shape and size of said entrance throat, and said means including means for changing the position of said cutting edge around the axis of said rotor whereby said mill may be made capable of accepting different materials having varying acceptance characteristics.

2. The apparatus of claim 1 in which the anterior surface is curved.

3. The apparatus of claim 1 in which the anterior surface is substantially flat.

4. The apparatus of claim 1 in which the angle between a plane tangential to the envelope and passing through the cutting edge and a plane tangential to the anterior surface and passing through the cutting edge is from 10° to 140°.

5. The apparatus of claim 4 in which the distance from the posterior surface to the envelope increases in the direction of rotation of the rotor.

6. The apparatus of claim 5 in which said housing includes a groove in which said feed bar is mounted.

7. The apparatus of claim 1 in which the cutting edge of said feed bar is a replaceable insert in said feed bar.

8. The apparatus of claim 1 in which said housing includes a groove in which said feed bar is mounted.

9. The apparatus of claim 1 in which said means for varying the entrance throat and the location of the cutting edge comprises said removable feed bar being replaceable with a feed bar having a different cross-section.

10. A shredding mill comprising a rotor, a plurality of knife edges carried by said rotor on the periphery thereof for rotation about the axis of the rotor, the path of the knife edges about said axis defining a cylindrical envelope, a housing in part defining an entrance chamber for feeding material to said rotor to be shredded, said entrance chamber including a generally wedge-shaped entrance throat, said throat being in part defined by said envelope, a feed bar removably mounted to said housing, said feed bar having two intersecting surfaces, one of said surfaces being anterior and the other posterior with respect to the direction of rotation of said rotor, said anterior surface in part defining said entrance throat, a stationary cutting edge positioned substantially at the intersection of said surfaces extending parallel to the axis of said rotor, said cutting edge being closely adjacent to said envelope for cooperating with the knife edges of said rotor, at least one additional feed bar, said additional feed bar also having two intersecting surfaces one of which is anterior to and the other posterior to the direction of rotation of said rotor when in place in said housing, said additional feed bar also having a stationary cutting edge positioned substantially at the intersection of its said surfaces providing a stationary cutting edge parallel to the axis of said rotor when said additional feed bar is in place in said housing, said additional feed bar having a different cross section than said first mentioned feed bar, and said feed bars being interchangeable for varying the shape and size of said entrance throat and the position of the cutting edge around the axis of said rotor.

* * * * *